US011480386B2

(12) United States Patent
Alves Ferreira et al.

(10) Patent No.: US 11,480,386 B2
(45) Date of Patent: Oct. 25, 2022

(54) REFRIGERATOR AND SHELVING SYSTEM FOR A REFRIGERATOR

(71) Applicant: WHIRLPOOL CORPORATION, Benton Harbor, MI (US)

(72) Inventors: Luiz Afranio Alves Ferreira, Joinville (BR); Jackeline Laurindo, Joinville (BR); Ignacio J. dos SANTOS, Joinville (BR); Gustavo Spezzia, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 4 days.

(21) Appl. No.: 17/198,717

(22) Filed: Mar. 11, 2021

(65) Prior Publication Data

US 2022/0290912 A1 Sep. 15, 2022

(51) Int. Cl.
*F25D 25/02* (2006.01)

(52) U.S. Cl.
CPC ..... *F25D 25/02* (2013.01); *F25D 2325/021* (2013.01); *F25D 2325/023* (2013.01)

(58) Field of Classification Search
CPC .. F25D 2325/023; F25D 25/02; F25D 23/067; F25D 2325/021; F25D 25/024; F25D 23/066; A47B 96/025; A47B 57/16; A47F 5/13; A47F 5/01; F24C 15/16
See application file for complete search history.

(56) References Cited

U.S. PATENT DOCUMENTS 1,930,773 A * 10/1933 Saum ..... F25D 25/02 211/153
1,997,432 A * 4/1935 Replogle ..... F25D 25/02 126/339
2,010,927 A * 8/1935 Paulus ..... F25D 25/02 312/351
2,021,464 A * 11/1935 Rickard ..... F25D 25/02 312/351
2,057,429 A * 10/1936 Heim ..... F25D 25/02 D15/89
2,091,607 A * 8/1937 Alfrede ..... F25D 25/02 211/153
2,095,130 A * 10/1937 Gates ..... F25D 25/02 160/222
2,262,578 A * 11/1941 Ellis ..... F25D 25/021 312/304
2,319,470 A * 5/1943 Nobles ..... F25D 25/02 211/153

(Continued)

FOREIGN PATENT DOCUMENTS

CN 206449999 U 8/2017
FR 2637057 * 3/1990 ..... F25D 25/02

(Continued)

*Primary Examiner* — Hiwot E Tefera
(74) *Attorney, Agent, or Firm* — Brooks Kushman P.C.

(57) ABSTRACT

A refrigerator shelving system includes first and second wire shelves. At least one of the first and second wire shelves is removably connected to a least one shelf support configured on a refrigerator liner. One of the first and second wire shelves is configured to be positioned horizontally and the other of the first and second wire shelves is configured to be positioned at least partially vertically such that a food item can be supported by both the first and second wire shelves.

16 Claims, 7 Drawing Sheets

(56) References Cited

U.S. PATENT DOCUMENTS

| | | | | | |
|---|---|---|---|---|---|
| 2,645,359 | A * | 7/1953 | Jewell | F25D 25/02 | 108/92 |
| 2,980,483 | A * | 4/1961 | Davis | F25D 25/02 | 312/297 |
| 3,625,371 | A * | 12/1971 | Dill | A47F 5/01 | 211/153 |
| 3,859,932 | A * | 1/1975 | Armstrong | F25D 25/02 | 108/75 |
| 5,642,924 | A * | 7/1997 | Wohlrab | A47B 57/16 | 211/134 |
| 5,855,424 | A * | 1/1999 | Hamilton | F25D 23/067 | 62/298 |
| 5,893,620 | A * | 4/1999 | Birgelis | F25D 25/024 | 312/408 |
| 7,878,344 | B2 * | 2/2011 | Martin | F24C 15/16 | 211/153 |
| 2016/0131416 | A1 * | 5/2016 | Sankhgond | F25D 23/067 | 312/408 |

FOREIGN PATENT DOCUMENTS

| | | | |
|---|---|---|---|
| KR | 19990049534 | A | 7/1999 |
| KR | 20170030234 | A | 3/2017 |
| WO | 2017211409 | A1 | 12/2017 |

* cited by examiner

REFRIGERATOR AND SHELVING SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes an internal panel, a first wire shelf, and a second wire shelf. The internal panel has at least one first shelving support protruding from the internal panel at a vertical first level and at least one second shelving support protruding from the internal panel at a second vertical level. The second vertical level is above the first level. The first wire shelf has first and second support rails and a first set of wires extending between the first and second support rails. The second wire shelf has third and fourth support rails and a second set wires extending between the third and fourth support rails. In a first configuration (i) the first and second support rails are configured to engage first and second shelving supports of the at least one first shelving support, respectively, such that the first wire shelf extends horizontally between the first and second support rails along the first vertical level, and (ii) the third and fourth support rails are configured to engage the second shelving support of the at least one first shelving support and a first shelving support of the at least one second shelving support, respectively, such that the second wire shelf extends at least partially vertically between the third and fourth support rails from the first vertical level to the second vertical level.

A refrigerator shelving system includes first and second wire shelves. At least one of the first and second wire shelves is removably connected to a least one shelf support configured on a refrigerator liner. One of the first and second wire shelves is configured to be positioned horizontally and the other of the first and second wire shelves is configured to be positioned at least partially vertically such that a food item can be supported by both the first and second wire shelves.

A refrigerator shelving system includes a wall, a first shelf, and a second shelf. The wall has a plurality of supports protruding therefrom. The first and second shelves are configured to engage the plurality of supports in a plurality of configurations. In a first of the plurality of configurations the first shelf is oriented horizontally and the second shelf extends at an upward angle from the first shelf such that a food item can be supported by both the first and second shelves.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
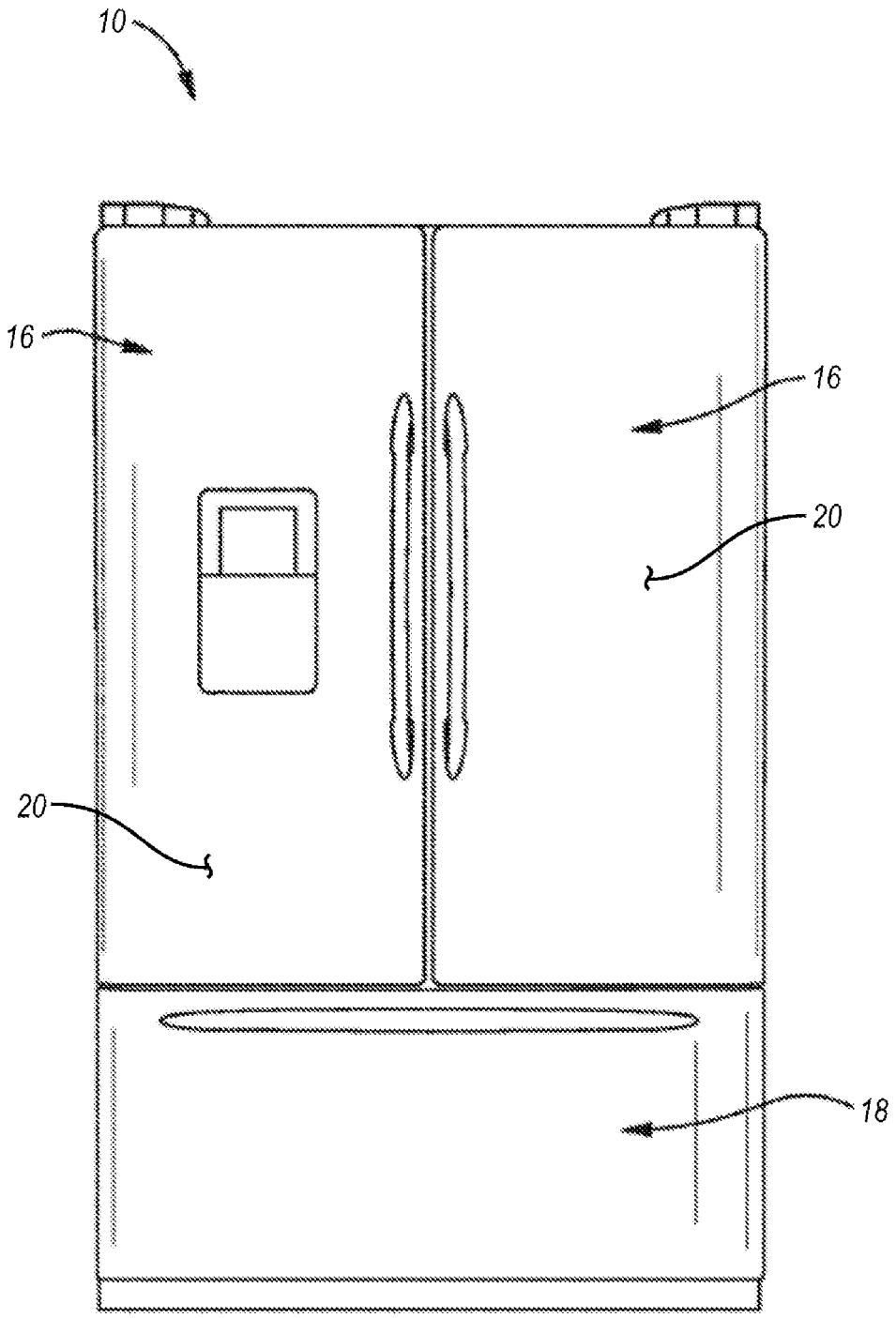
FIG. 1 is an elevated front view of a French-Door Bottom Mount type refrigerator appliance.
Figure 2:
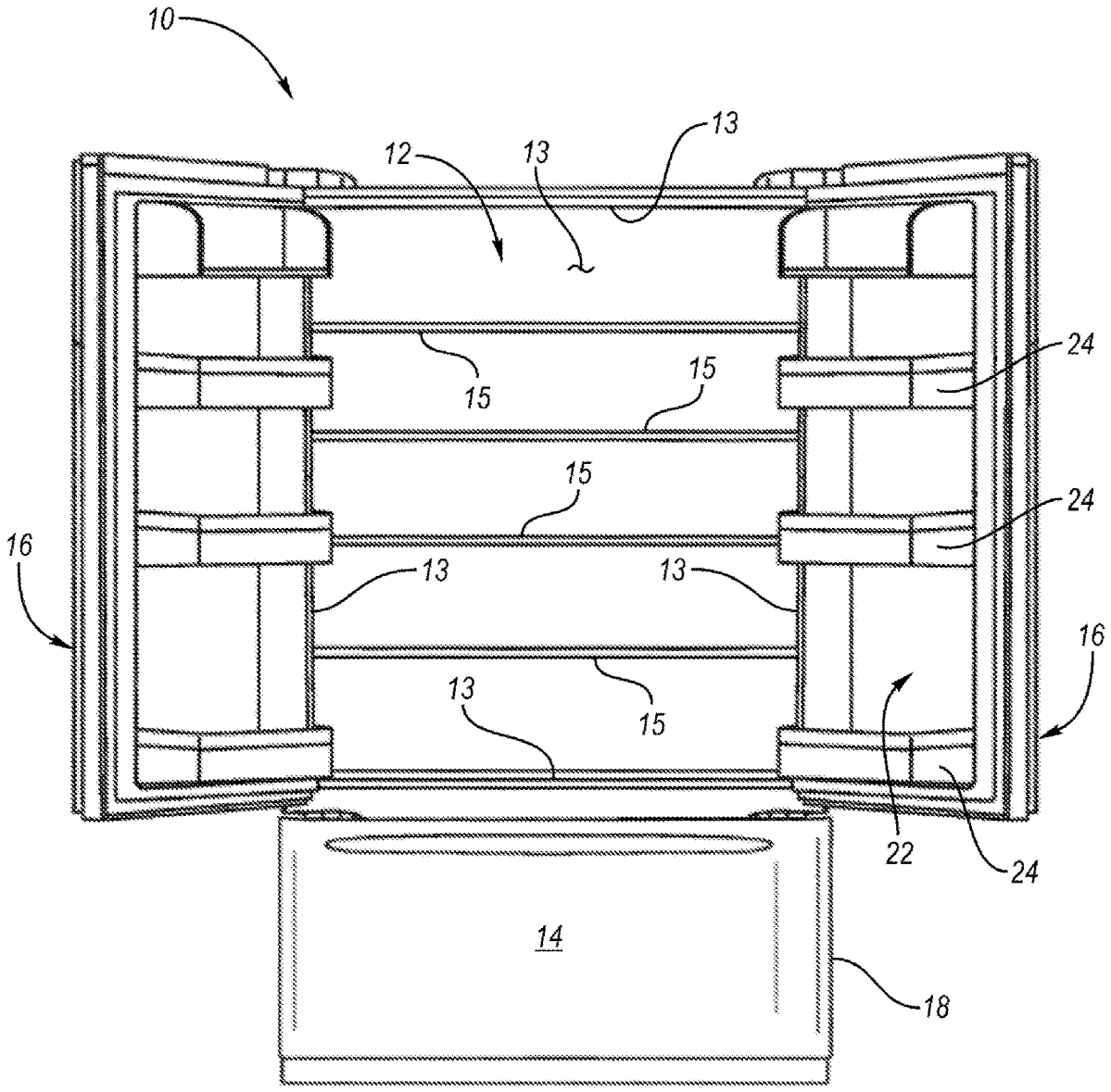
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or walls 13 that define the fresh food compartment 12 and the freezer compartment 14. The walls 13 may more specifically form an internal liner of the refrigerator 10. The walls 13 may include a rear or back wall, a top wall, a bottom wall, and two side walls. One or more shelves 15 may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-11, a shelving system 30 for the refrigerator 10, shown in various configurations, is illustrated. The shelving system 30 may be representative of one or more of the shelves 15 depicted in FIG. 2. The shelving system 30 includes a plurality of supports 32 that protrude from one of the walls 13, The wall 13 may be a side wall that partially forms the internal liner of the refrigerator 10. At least one of the shelving supports 32 protrude from the wall 13 at a first vertical level 34, at least one of the shelving supports 32 protrude from the wall 13 at a second vertical level 36, and at least one of the shelving supports 32 protrude from the wall 13 at a third vertical level 38. The second vertical level 36 is disposed above the first vertical level 34. The third vertical level 38 is disposed above the first vertical level 34 and the second vertical level 36. The shelving supports 32 may protrude outward from the wall 13. The shelving supports 32 may be U-shaped (e.g., see the shelving supports 32 on the second vertical level 36 and third vertical level 38). Several shelving supports 32 may be formed from a rail 40 and several upward extending posts 42 (e.g., see the shelving supports 32 on the first vertical level 34). Each region on either side of a post 42, that includes the post 42 and at least a portion of the rail 40, may be representative of one of the shelving supports 32 in a system that includes a rail and several upward extending posts. In the illustrated example, the rail 40 and posts 42 may be said to form at least six shelving supports 32, each comprising the region on each side of each of the three leftmost posts 42.

The shelving system 30 includes a first shelf 44 and a second shelf 46. The first shelf 44 and the second shelf 46 may be wire shelves. The first shelf 44 and the second shelf 46 may be configured to engage one or more of the plurality of supports 32 in a plurality of configurations. The first shelf 44 and the second shelf 46 may each be removably connected to one or more of the plurality of supports 32 such that the first shelf 44 and the second shelf 46 may be transitioned between the plurality of configurations. More specifically, the first shelf 44 and the second shelf 46 may be positioned on upward facing surfaces of one or more of the shelving supports 32 (e.g., an upward facing surface 48 of the U-shaped supports 32 or an upward facing surface 50 of the rail 40) and between upright portions of the shelving supports 32 (e.g., upright portions 52 of the U-shaped supports 32 or the posts 42 that extend upward from the rail 40) such that gravity holds the first shelf 44 and the second shelf 46 down and onto the shelving supports 32 and such that the upright portions of the shelving supports 32 limit or restrict horizontal movement of the first shelf 44 and the second shelf 46. The first shelf 44 or the second shelf 46, however, may be lifted vertically upward and off of a first of the shelving supports 32 and placed onto a second of the shelving supports 32 to transition to another configuration.

The first shelf 44 has two support rails (hereinafter referred to as the first support rail 54 and the second support rail 56) and a set or plurality of wires (hereinafter referred to as the first set of wires 58). The first and second support rails 54, 56 may also be referred to as front and rear support rails, respectively, or vice versa. Each of the first set of wires 58 extends between and is secured to each of the first support rail 54 and the second support rail 56. The first set of wires 58 may be arranged such that adjacent wires of the first set of wires 58 are equidistantly spaced apart, which is denoted as distance $X_1$ in FIG. 11. The second shelf 46 has two support rails (hereinafter referred to as the third support rail 60 and the fourth support rail 62) and a set or plurality of wires (hereinafter referred to as the second set of wires 64). The third and fourth support rails 60, 62 may also be referred to as front and rear support rails, respectively, or vice versa. Each of the second set of wires 64 extends between and is secured to each of the third support rail 60 and the fourth support rail 62. The second set of wires 64 may be arranged such that adjacent wires of the second set of wires 64 are equidistantly spaced apart, which is denoted as distance $X_2$ in FIG. 11. The wires of the second set of wires 64 are interleaved with the wires of the first set of wires 58. The distance between adjacent wires of the interleaved first and second sets of wires 58, 64 may be half of either or both distances $X_1$ and $X_2$. The distance between adjacent wires of the interleaved first and second sets of wires 58, 64 is denoted as distance Y in FIG. 11

Figure 3:
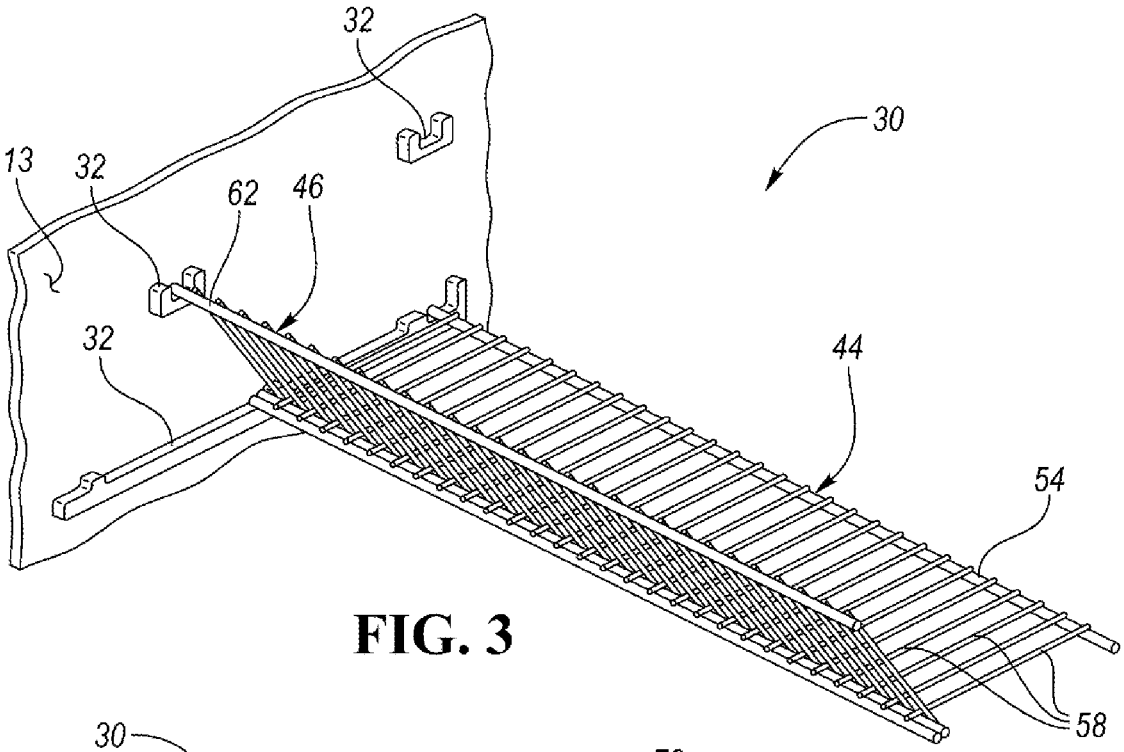
FIG. 3 is an isometric view of a refrigerator shelving system arranged in a first configuration.
Figure 4:
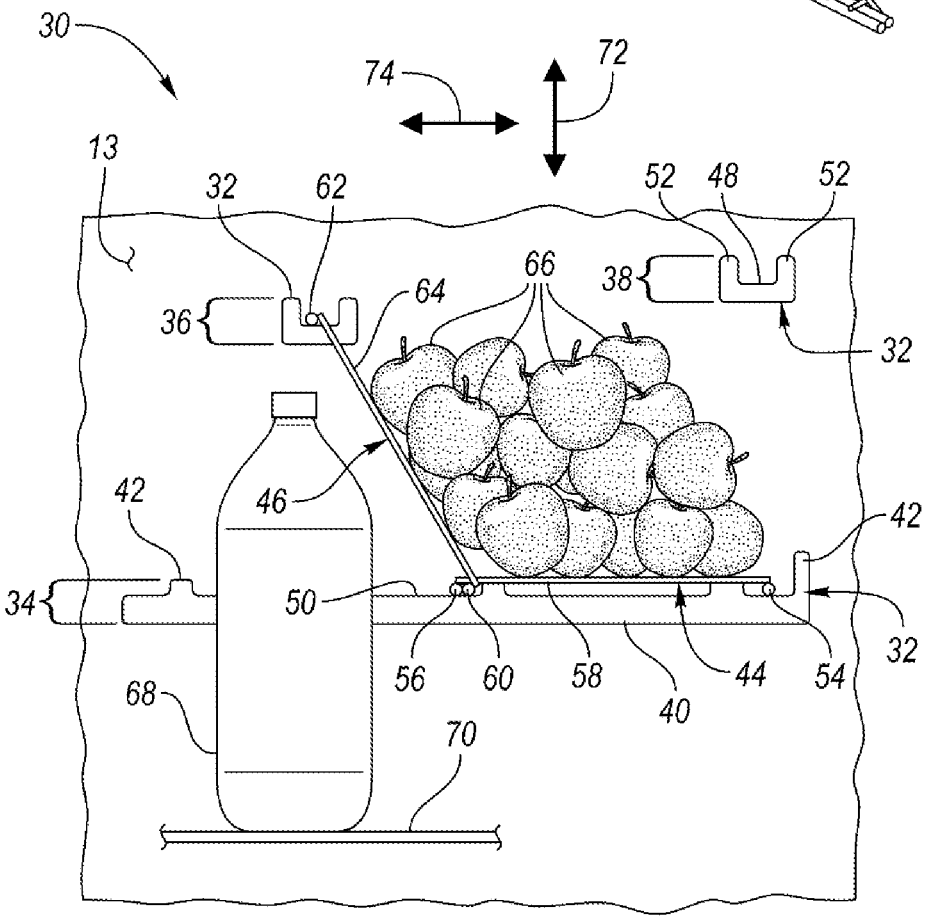
FIG. 4 is a side view of the refrigerator shelving system arranged in the first configuration.

In a first configuration of the shelving system 30 depicted in FIGS. 3 and 4, the first shelf 44 is positioned substantially horizontal and the second shelf 46 is positioned at least partially vertical such that one or more first food items 66 can be supported by both the first shelf 44 and the second shelf 46. The configuration is similar to a crisper drawer having a bottom surface that is partially horizontal and partially angled. Substantially horizontal may refer to any incremental value that is between exactly horizontal and 5° from exactly horizontal. Such a configuration may also provide clearance for one or more second food items 68 that are disposed on a secondary shelf 70 that is positioned below the first vertical level 34. The second shelf 46 may extend at an upward angle away from the first shelf 44 in the first configuration such that the second shelf 46 extends both vertically from the first vertical level 34 to the second vertical level 36 and horizontally away from the first shelf 44. Stated in other terms, the direction that the second shelf 46 extends away from first shelf 44 has both a vertical component and a horizontal component, where the vertical and horizontal directions are depicted by double ended arrows 72 and 74, respectively. It is noted that double ended arrow 72 extends in the direction of gravity and double ended arrow 74 extends in the direction that is perpendicular to gravity.

More specifically, with respect to the first configuration of the shelving system 30 depicted in FIGS. 3 and 4, the first support rail 54 and the second support rail 56 of the first shelf 44 are configured to engage a first shelving support and a second shelving support of the at least one shelving support 32 at the first vertical level 34, respectively, such that the first shelf 44 extends substantially horizontal between the first support rail 54 and the second support rail 56 along the first vertical level 34. Also, with respect to the first configuration of the shelving system 30 depicted in FIGS. 3 and 4, the third support rail 60 and the fourth support rail 62 of the second shelf 46 are configured to engage the second shelving support of the at least one shelving supports 32 at the first vertical level 34 (i.e., the shelving support 32 supporting the second support rail 56 of the first shelf 44) and a first shelving support of the at least one second shelving support 32 at the second vertical level 36, respectively, such that the second shelf 46 extends at least partially vertical between the third support rail 60 and the fourth support rail 62 from the first vertical level 34 to the second vertical level 36. The second shelf 46 may, more specifically, extend from the first vertical level 34 to the second vertical level 36 at an angle such that the second shelf 46 extends at least partially horizontal between the third support rail 60 and the fourth support rail 62.

Figure 5:
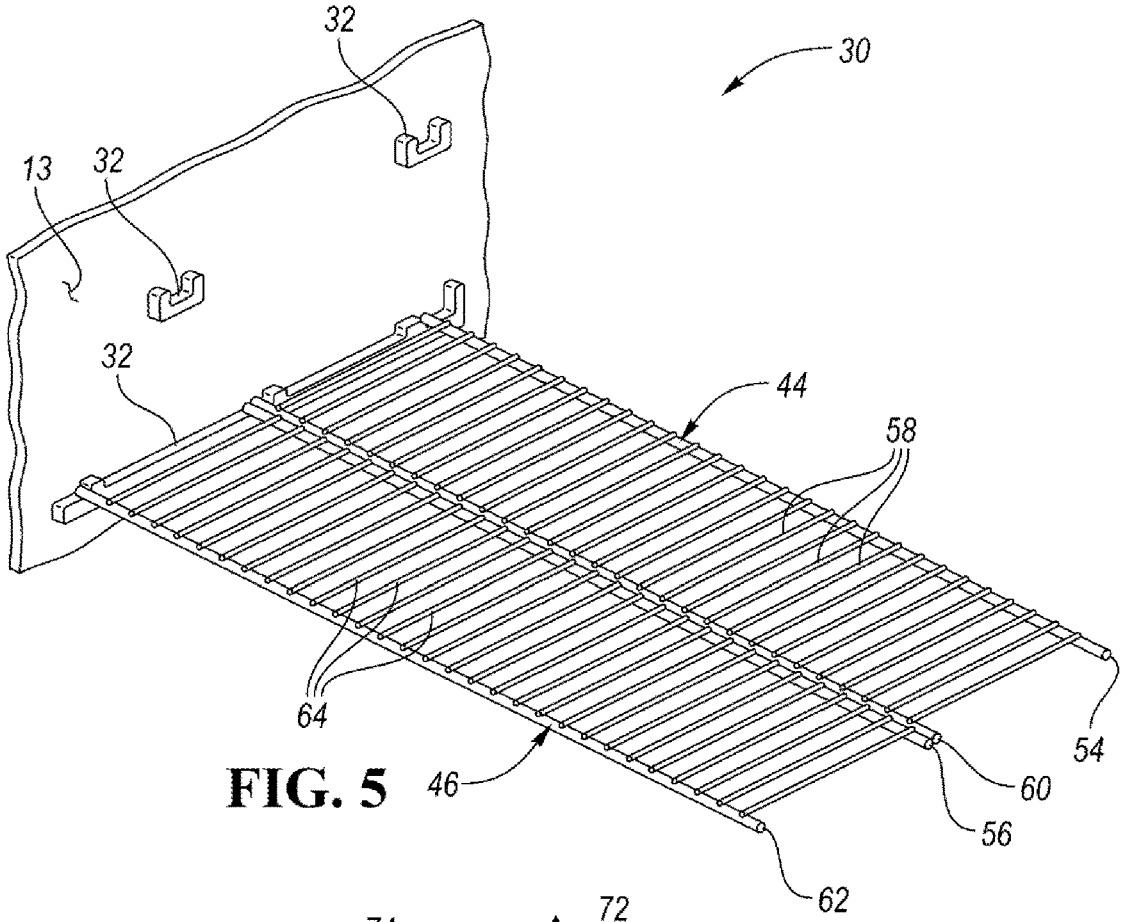
FIG. 5 is an isometric view of the refrigerator shelving system arranged in a second configuration.
Figure 6:
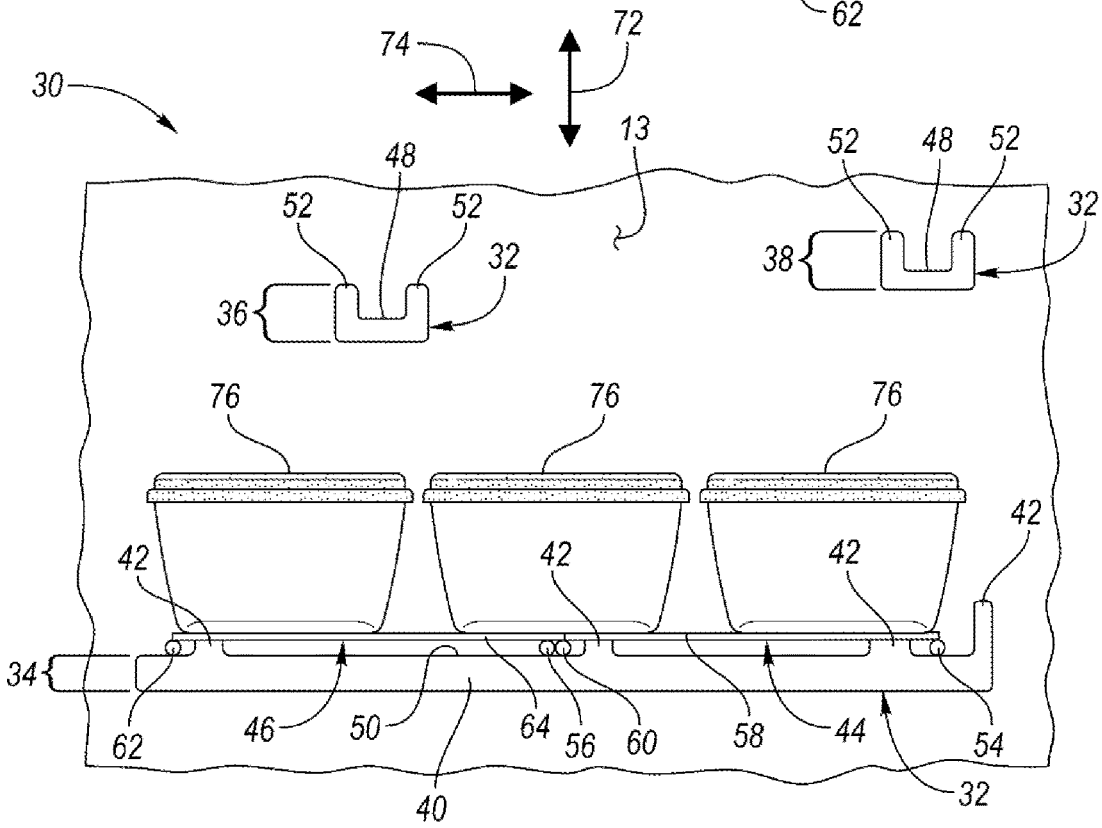
FIG. 6 is a side view of the refrigerator shelving system arranged in the second configuration.

In a second configuration of the shelving system 30 depicted in FIGS. 5 and 6, the first support rail 54 and the second support rail 56 of the first shelf 44 are configured to engage the first shelving support and the second shelving support of the at least one shelving support 32 at the first vertical level 34, respectively, such that the first shelf 44 extends substantially horizontal between the first support rail 54 and the second support rail 56 along the first vertical level 34. Also, with respect to the second configuration of the shelving system 30 depicted in FIGS. 5 and 6, the third support rail 60 and the fourth support rail 62 of the second shelf 46 are configured to engage the second shelving support of the at least one shelving supports 32 at the first vertical level 34 (i.e., the shelving support 32 supporting the second support rail 56 of the first shelf 44) and a third shelving support of the at least one shelving supports 32 at the first vertical level 34 such that the second shelf 46 extends horizontally between the third support rail 60 and the fourth support rail 62 along the first vertical level 34, and such that the second shelf 46 extends from an end of the first shelf 44 and does not overlap with the first shelf 44. Such a configuration may provide increased or a maximum shelving space for multiple food items or storage containers 76 at the first vertical level 34.

Figure 7:
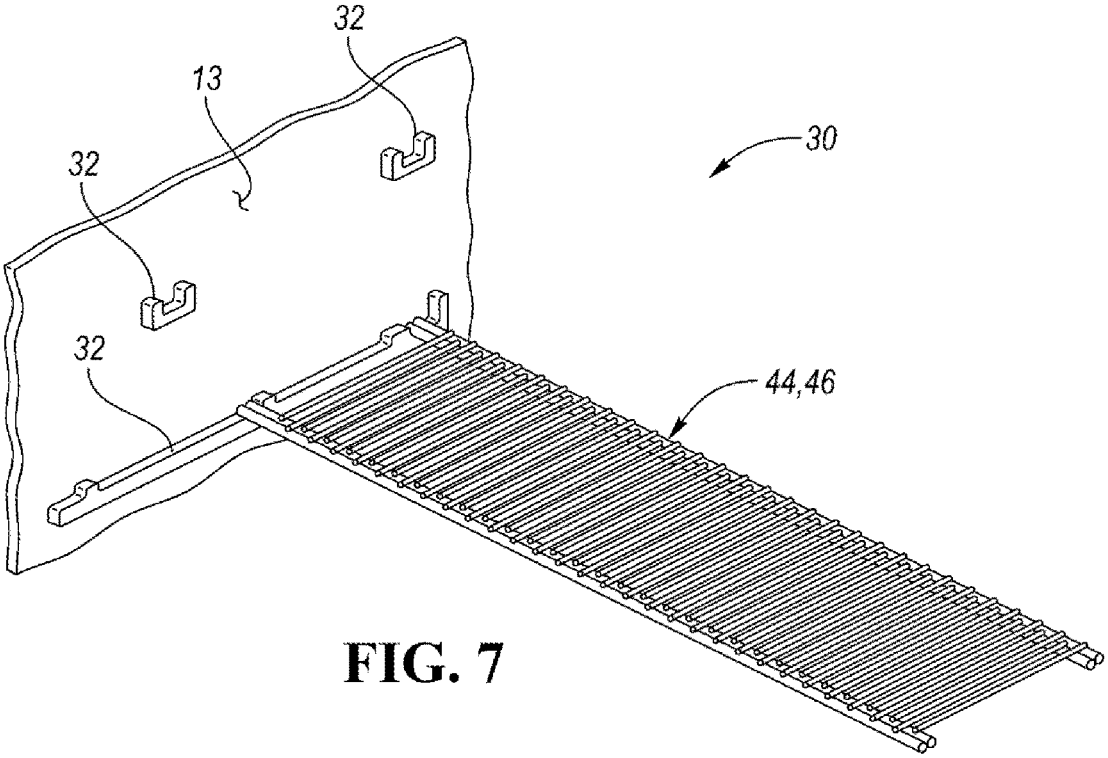
FIG. 7 is an isometric view of the refrigerator shelving system arranged in a third configuration.
Figure 8:
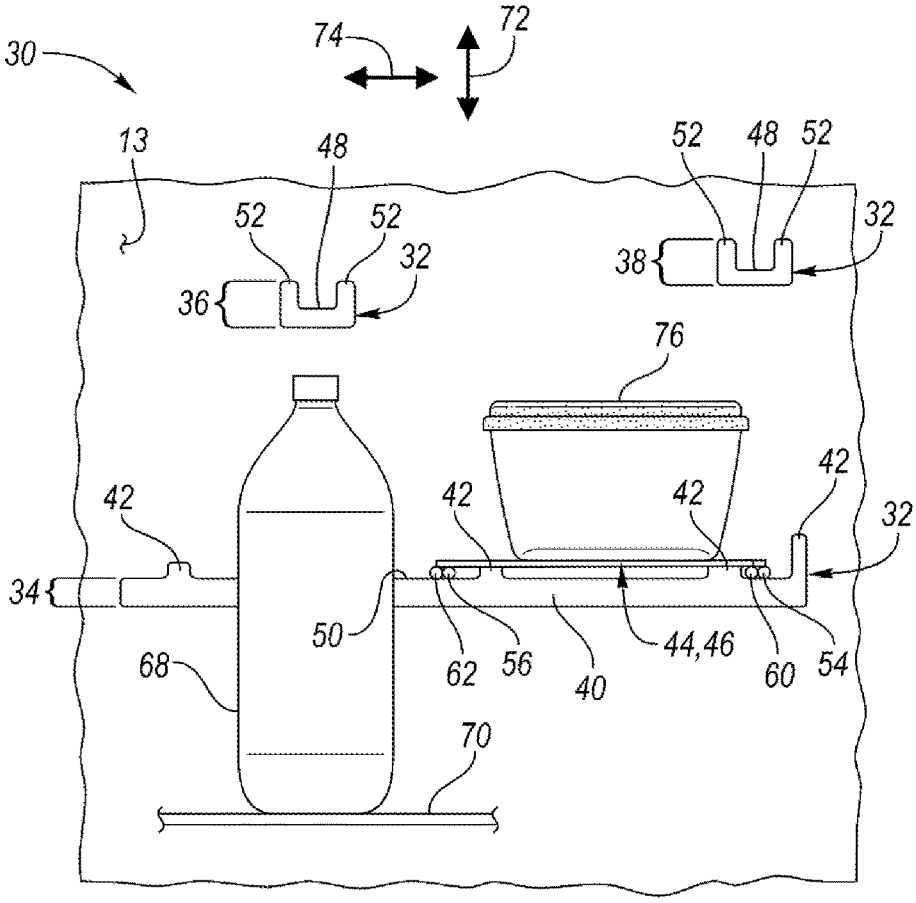
FIG. 8 is a side view of the refrigerator shelving system arranged in the third configuration.

In a third configuration of the shelving system 30 depicted in FIGS. 7 and 8, the first support rail 54 and the second support rail 56 of the first shelf 44 are configured to engage the first shelving support and the second shelving support of the at least one shelving support 32 at the first vertical level 34, respectively, such that the first shelf 44 extends substantially horizontal between the first support rail 54 and the second support rail 56 along the first vertical level 34. Also, with respect to the third configuration of the shelving system 30 depicted in FIGS. 7 and 8, the third support rail 60 and the fourth support rail 62 of the second shelf 46 are configured to engage the first shelving support and the second shelving support of the at least one shelving support 32 at the first vertical level 34, respectively, such that the second shelf 46 extends substantially horizontal between the third support rail 60 and the fourth support rail 62 along the first vertical level 34, and such that the second shelf 46 and the first shelf 44 overlap. Such a configuration may provide a reduce amount of shelving space for multiple food items or storage containers 76 at the first vertical level 34, but may also provide clearance for the one or more second food items 68 that are disposed on the secondary shelf 70 that is positioned below the first vertical level 34.

Figure 9:
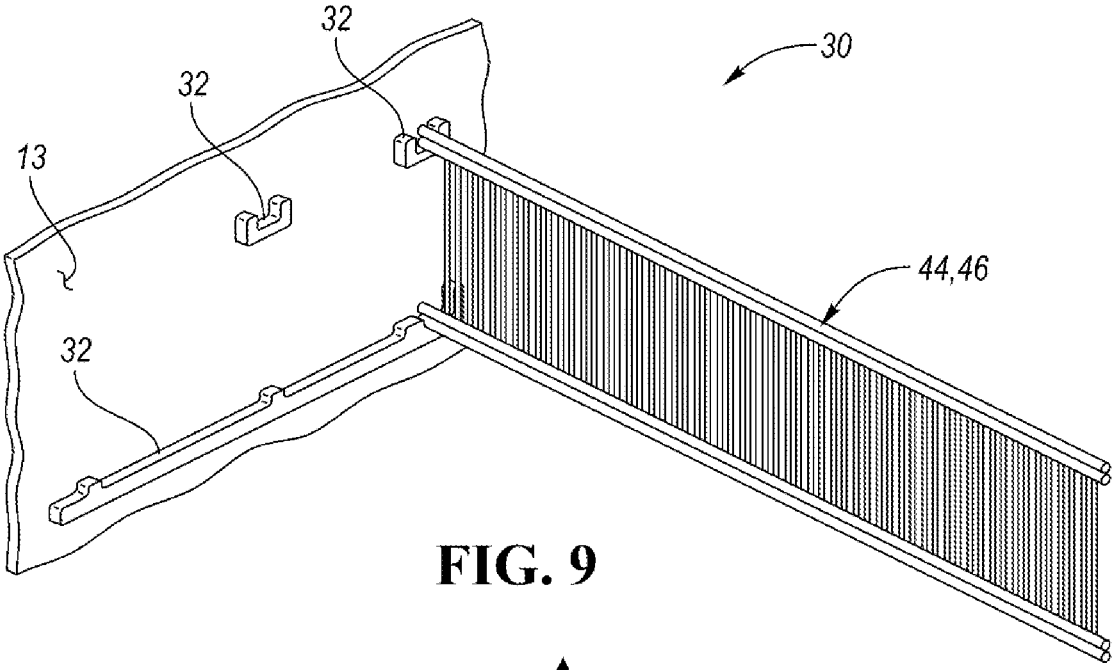
FIG. 9 is an isometric view of the refrigerator shelving system arranged in a fourth configuration.
Figure 10:
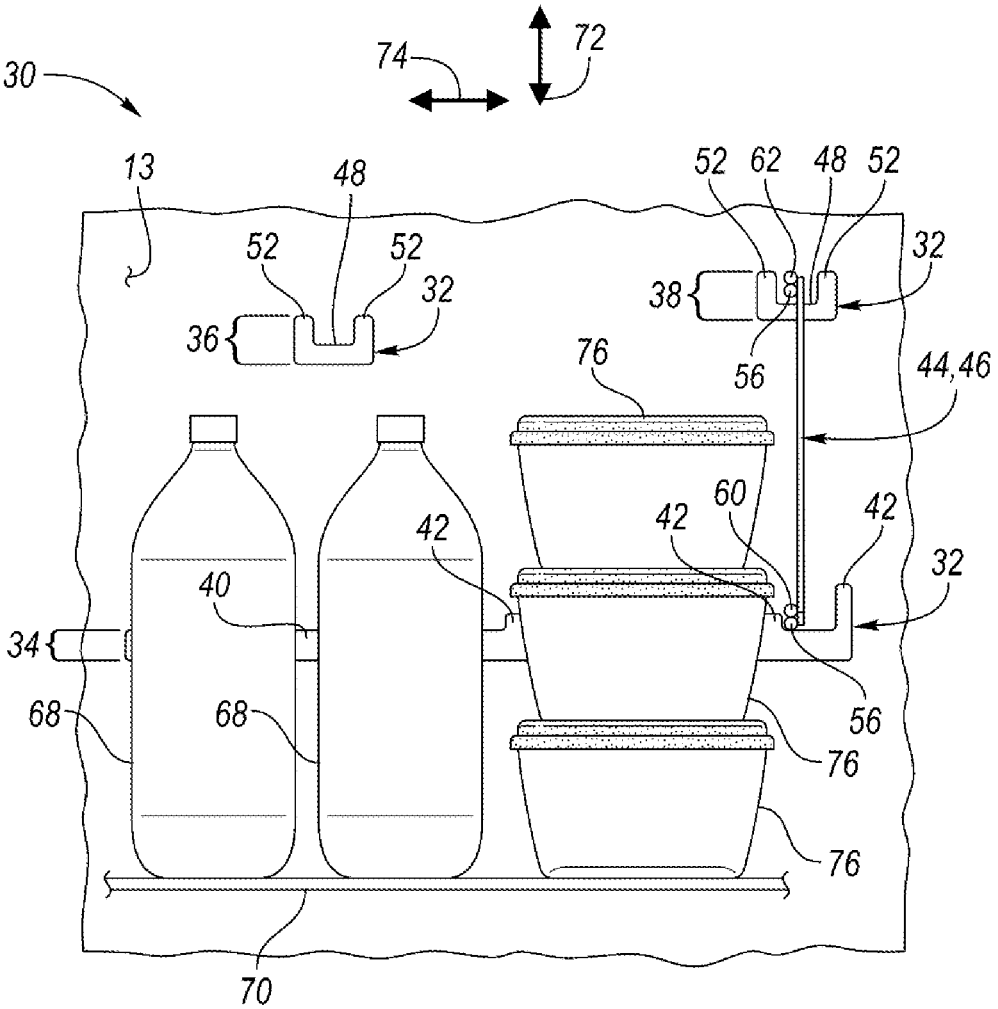
FIG. 10 is a side view of the refrigerator shelving system arranged in the fourth configuration.
Figure 11:
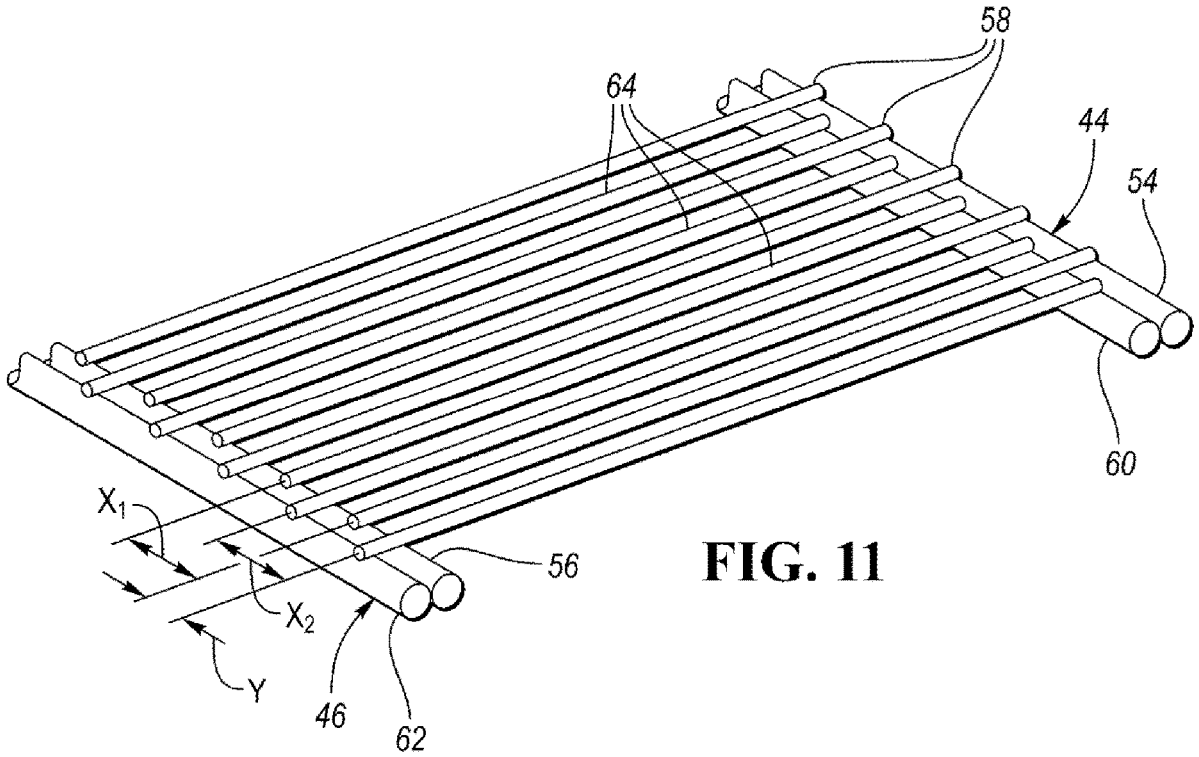
FIG. 11 is an isometric view of portions of wire shelves.

In a fourth configuration of the shelving system 30 depicted in FIGS. 9 and 10, the first support rail 54 and the second support rail 56 of the first shelf 44 are configured to engage the first shelving support of the at least one shelving support 32 at the first vertical level 34 and a first shelving support of the at least one shelving support 32 at the third vertical level 38, respectively, such that the first shelf 44 extends substantially vertical between the first support rail 54 and the second support rail 56 from the first vertical level 34 to the third vertical level 38. Substantially vertical may refer to any incremental value that is between exactly vertical and 5° from exactly vertical. Also, with respect to the fourth configuration of the shelving system 30 depicted in FIGS. 9 and 10, the third support rail 60 and the fourth support rail 62 of the second shelf 46 are configured to engage the first shelving support of the at least one shelving support 32 at the first vertical level 34 and the first shelving support of the at least one shelving support 32 at the third vertical level 38, respectively, such that the second shelf 46 extends substantially vertically between the third support rail 60 and the fourth support rail 62 from the first vertical level 34 to the third vertical level 38, and such that the second shelf 46 and the first shelf 44 overlap. Such a configuration may increase or maximize clearance for food items (shown as the one or more second food items 68 and containers 76) that are disposed on the secondary shelf 70 that is positioned below the first vertical level 34.

It is noted that the Figures depicted herein only show first ends of the first shelf 44 and second shelf 46 being supported via shelving supports 32. However, it should be understood that a second set of shelving supports that support the opposing second ends first shelf 44 and second shelf 46 may be included but are not shown for illustrative purposes. For example, a second plurality of shelving supports may protrude from a second wall 13 within the fresh food compartment 12 or may be defined on one or more brackets that are secured to a second wall of the fresh food compartment 12, where the second plurality of shelving supports are a mirror image of the shelving supports depicted in the Figures.

It should be understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

an internal panel having, at least one first shelving support protruding from the internal panel at a first vertical level, and at least one second shelving support protruding from the internal panel at a second vertical level, wherein the second vertical level is above the first level;

a first wire shelf having first and second support rails and a first set of wires extending between the first and second support rails; and a second wire shelf having third and fourth support rails and a second set wires extending between the third and fourth support rails, wherein the third support rail is disposed between the first and second support rails, wherein in a first configuration (i) the first and second support rails are configured to engage first and second shelving supports of the at least one first shelving support, respectively, such that the first wire shelf extends horizontally between the first and second support rails along the first vertical level, and (ii) the third and fourth support rails are configured to engage the second shelving support of the at least one first shelving support and a first shelving support of the at least one second shelving support, respectively, such that the second wire shelf extends at least partially vertically between the third and fourth support rails from the first vertical level to the second vertical level, and wherein the first set of wires are interleaved with the second set of wires interlocking the first wire shelf to the second wire shelf.

2. The refrigerator appliance of claim 1, wherein in the first configuration the second wire shelf extends from the first vertical level to the second vertical level at an angle such that the second wire shelf extends at least partially horizontally between the third and fourth support rails.

3. The refrigerator appliance of claim 1, wherein in a second configuration (i) the first and second support rails are configured to engage the first and second shelving supports of the at least one first shelving support, respectively, such that the first wire shelf extends horizontally between the first and second support rails along the first vertical level, and (ii) the third and fourth support rails are configured to engage the second shelving support of the at least one first shelving support and a third shelving support of the at least one first shelving support, respectively, such that the second wire shelf extends horizontally between the third and fourth support rails along the first vertical level.

4. The refrigerator appliance of claim 3, wherein in a third configuration (i) the first and second support rails are configured to engage the first and second shelving supports of the at least one first shelving support, respectively, such that the first wire shelf extends horizontally between the first and second support rails along the first vertical level, and (ii) the third and fourth support rails are configured to engage the first and second shelving supports of the at least one first shelving support, respectively, such that the second wire shelf extends horizontally between the third and fourth support rails along the first vertical level and such that the second wire shelf overlaps the first wire shelf.

5. The refrigerator appliance of claim 4 further comprising at least one third shelving support protruding from the internal panel at a third vertical level, wherein the third vertical level is above the first vertical level, and wherein in a fourth configuration (i) the first and second support rails are configured to engage the first shelving support of the at least one first shelving support and a first shelving support of the at least one third shelving support, respectively, such that the first wire shelf extends vertically between the first and second support rails from the first vertical level to the third vertical level, and (ii) the third and fourth support rails are configured to engage the first shelving support of the at least one first shelving support and the first shelving support of the at least one third shelving support, respectively, such that the second wire shelf extends vertically between the third and fourth support rails from the first vertical level to the third vertical level and such that the second wire shelf overlaps the first wire shelf.

6. The refrigerator appliance of claim 5, wherein in the fourth configuration the first set of wires are interleaved with the second set of wires.

7. The refrigerator appliance of claim 1, wherein the second support rail is disposed between the third and fourth support rails.

8. A refrigerator shelving system comprising:

a first wire shelf including a first front support rail and a first rear support rail, wherein the first front and first rear support rails are interconnected by a first plurality of wires; and a second wire shelf including a second front support rail and a second rear support rail, wherein the second front support rail is disposed between the first front support rail and the first rear support rail, wherein the second front and second rear support rails are interconnected by a second plurality of wires, wherein the wires of the second plurality of wires are interleaved with the wires of the first plurality of wires interlocking the first wire shelf to the second wire shelf, wherein at least one of the first and second wire shelves is removably connected to at least one shelf support configured on a refrigerator liner, and wherein in a first configuration (i) the first front support rail and the first rear support rail are configured to engage first and second shelving supports of the at least one shelf support such that the first wire shelf extends horizontally between the first front support rail and the first rear support rail along a first vertical level and (ii) the second wire shelf is positioned at least partially vertically from the first vertical level to a second vertical level such that a food item can be supported by both the first and second wire shelves.

9. The refrigerator shelving system of claim 8, wherein the wires of the first plurality of wires are equidistantly spaced apart.

10. The refrigerator shelving system of claim 8, wherein the wires of the second plurality of wires are equidistantly spaced apart.

11. The refrigerator shelving system of claim 8, wherein the at least one shelf support includes a plurality of shelf supports.

12. The refrigerator shelving system of claim 8, wherein the first rear support rail is disposed between the second front support rail and the second rear support rail.

13. A refrigerator shelving system comprising:

a wall having a plurality of supports protruding therefrom;

a first shelf including a first front support rail and a first rear support rail interconnected by a first plurality of wires; and a second shelf including a second front support rail and a second rear support rail interconnected by a second plurality of wires, wherein the second front support rail is disposed between the first front support rail and the first rear support rail, wherein the wires of the second plurality of wires are interleaved with the wires of the first plurality of wires interlocking the first shelf to the second shelf, wherein the first and second shelves configured to engage the plurality of supports in a plurality of configurations, wherein in a first configuration (i) the first front support rail and the first rear support rail are configured to engage first and second shelving supports of the plurality of supports such that the first shelf extends horizontally between the first front support rail and the first rear support rail along a first vertical level and (ii) the second shelf is positioned at least partially vertically from the first vertical level to a second vertical level such that a food item can be supported by both the first and second shelves, and wherein the second shelf extends at an upward angle from the first shelf.

14. The refrigerator appliance of claim 13, wherein in a second of the plurality of configurations the first and second shelves overlap and are oriented horizontally.

15. The refrigerator appliance of claim 13, wherein in a second of the plurality of configurations the first and second shelves overlap and are oriented vertically.

16. The refrigerator shelving system of claim 13, wherein the first rear support rail is disposed between the second front support rail and the second rear support rail.

* * * * *